US005388313A

United States Patent [19]

Cameron

[11] Patent Number: 5,388,313

[45] Date of Patent: Feb. 14, 1995

[54] LOCKING CLIP

[76] Inventor: Robert W. Cameron, 4972 Northwest Rd., Bellingham, Wash. 98226

[21] Appl. No.: 175,742

[22] Filed: Dec. 30, 1993

[51] Int. Cl.[6] ..... A44B 21/00

[52] U.S. Cl. ..... 24/537; 24/265 EC

[58] Field of Search ..... 24/537, 513, 503, 265 H, 24/265 EC

[56] References Cited

U.S. PATENT DOCUMENTS

| | | | |
|---|---|---|---|
| 308,583 | 11/1884 | Unckrich | 24/537 X |
| 1,110,579 | 9/1914 | Seeber | 24/537 |
| 1,193,895 | 8/1916 | Hemingway | 24/537 X |
| 1,565,392 | 12/1925 | Powers | 24/265 H |
| 2,583,680 | 1/1952 | Brennan | 24/537 X |
| 4,170,299 | 10/1979 | Clements | 24/562 X |

*Primary Examiner*—James R. Brittain

*Attorney, Agent, or Firm*—Todd N. Hathaway

[57] ABSTRACT

A clip assembly for gripping a sheet of material. The assembly includes first and second jaw members having ramp portions which are joined along a common hinge. The ramp portions form divergent inclined planes, and are surrounded by a sliding collar. As the sliding collar is moved from the hinge area toward the grip portions of the jaws, the latter are forced together against the sheet of material. A releasable ratchet pawl locks the sliding collar against reverse movement. The clip assembly is suitable for fabrication from injection molded plastic.

18 Claims, 4 Drawing Sheets

LOCKING CLIP

FIELD OF THE INVENTION

The present invention relates generally to clips and similar gripping devices and, more particularly, to a locking clip which grips sheets of cloth, plastic, or other material.

BACKGROUND ART

Numerous clips and other gripping devices are known to those skilled in the art. A particular example of a clip which is in common usage is the suspender clip. Accordingly, for illustrative purposes the present invention will be discussed in the context of a suspender clip, although it should be understood that the invention is not limited to this particular application.

An exemplary prior art suspender clip 10 is shown in FIG. 1. As can be seen, this has a loop portion 12 which attaches to the bottom end of one of the suspender straps 14. The loop portion 12 forms the upper end of a fixed jaw portion 16. The fixed jaw portion has teeth (not shown) which are arranged in opposition to the teeth 18 on the movable jaw portion 20. The two jaw portions receive the trouser fabric or other material 22 and are forced into engagement therewith by a pivoting clasp member 24. The base of the clasp member is supported for pivoting movement by first and second sheet metal tabs 26 which rotate in bores 27 provided in outwardly bent ear portions 28 of the fixed jaw of the clip.

Prior art suspender clips of the type described above, and similar types of clips used for other applications (e.g., for grasping other materials), exhibit several inherent deficiencies. Firstly, the sheet metal construction necessitates the use of relatively sharp teeth and high contact pressures to ensure engagement between the clip and the fabric. As a result, the fabric suffers a degree of damage each time the clip is attached to it, to the point that the attachment points on the trousers usually wear out; this wear is aggravated by back-and-forth motion of the suspender relative to the trouser band, such that the teeth twist against the face of the fabric.

Another serious deficiency of the prior art clip design is that the clips themselves invariably wear out before the suspender straps. For example, the pivoting sheet metal tabs 26 and bores 27 quickly wear out in use, and the sheet metal structure in general is subject to rapid wear and damage. As a result, it is often necessary for a consumer to dispose of an otherwise perfectly serviceable set of suspenders simply because one or more of the clips have become inoperative.

Yet another inherent drawback of clips having the construction described above is that they are relatively expensive to produce.

Accordingly, there exists a need for a clip device for use with suspenders (or other straps, cords, ropes, etc.) for the engagement of fabric, cloth, plastic, or other sheet material which exhibits long service life, which does not damage the fabric or other material with which it is used, and which is suitable as a replacement unit for a damaged conventional suspender clip. Moreover, there is a need for such a device which is economical to manufacture.

SUMMARY OF THE INVENTION

The present invention has solved the problems cited above, and is a clip assembly for gripping a sheet of material. Broadly, the clip assembly comprises: (a) first and second jaw members mounted to a hinge portion in opposition to one another, each jaw member comprising a grip portion for engaging the sheet of material, and a ramp portion which extends from the hinge portion toward the grip portion of the jaw, the ramp portion of the first and second jaw members forming inclined planes which diverge from one another from said hinge portion toward said grip portion; (b) a collar member surrounding the ramp portions of the first and second jaw members, so that in response to sliding movement of the collar member from the hinge portion toward the grip portions, the collar member rides up the divergent inclined planes so as to force the grip portions together against the sheet of material, and (c) ratchet means in engagement with the collar member so as to prevent reverse movement of the collar member from the grip portions of the jaw members toward the hinge portion, and for selectively releasing the collar member for said reverse movement so as to permit disengagement of the jaw members from the sheet of material. Preferably, the clip assembly also comprises a loop portion for attachment to the load-bearing cord.

The ratchet means may comprise a first set of ratchet teeth formed on the collar member, and a second set of ratchet teeth mounted to at least one of the jaw members. Preferably, the ratchet means may further comprise a ratchet pawl having the second set of teeth formed thereon, the ratchet pawl being mounted to the jaw member for resilient deflection so as to permit the first set of teeth to ride over the second set of teeth as the collar member is moved toward the grip portions of the jaw members. The assembly may further comprise means for selectively deflecting the ratchet pawl so that the second set of teeth move out of engagement with the first set of teeth, so as to permit the reverse movement of the collar member. The ratchet pawl may comprise an elongate tooth member having a first end which is hingedly mounted to the jaw portion and a second end which is free so as to permit displacement of the pawl so that the sets of teeth move out of engagement with one another. In this case, the means for selectively deflecting the ratchet pawl may comprise a button portion mounted on the end of the elongate tooth member so as to permit selective manual deflection of the ratchet pawl.

The grip portions of the first and second jaw members may each comprise a general planar grip face which defines a contact area for engaging the sheet of material, and a plurality of teeth formed on the grip face for engaging the material. The plurality of teeth on the first grip face can be configured to be received in the valleys between the teeth on the second grip face, and the teeth may comprise a plurality of parallel ridges formed on the grip faces.

The loop portion of the clip assembly may be selectively openable so as to receive a loop which is formed on the end of the load-bearing cord. The opening loop may comprise (a) a fixed lug member which is mounted proximate a first end of the hinge portion of the jaw members, (b) an arm member having a first end which is hingedly mounted to the hinge portion proximate a second end thereof and a second end which defines an opening with the fixed lug member for receiving the loop in the end of the cord, and (c) latch means for selectively attaching the second end of the arm member to the fixed lug member so that the loop on the end of the cord is retained in a closed loop formed intermediate the arm member and the hinge portion of the clip assembly. Alternatively, the loop portion of the clip assembly may be a fixed ring portion to which the end of the cord may be tied.

The clip assembly may also further comprise hinge means for pivotally mounting the loop portion of the assembly to the jaw members of the assembly. The hinge means may comprise a first plate member which is mounted to the loop portion of the assembly and has a flat bearing surface formed thereon, a second plate member which is mounted to the jaw members and has a flat bearing surface formed thereon, and a pivot pin for mounting the plate members together so that the flat bearing surfaces abut one another for pivoting movement along a common plane. The common plane may preferably lie substantially parallel to the sheet of material when the latter is received in the jaw members, so that the hinge means eliminates twisting movement of the jaw members against contact surfaces of the sheet.

DETAILED DESCRIPTION a. Overview

Figure 1:
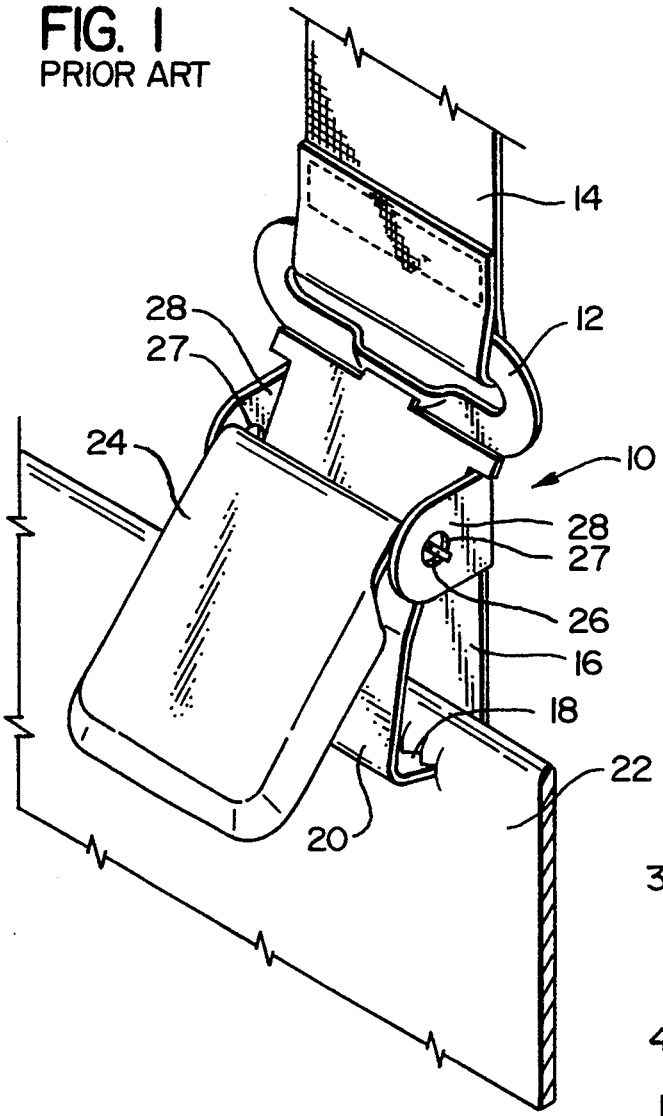
FIG. 1 PRIOR ART
FIG. 1 is a perspective view of a prior art suspender clip, of the type typically fabricated of sheet metal.
Figure 2:
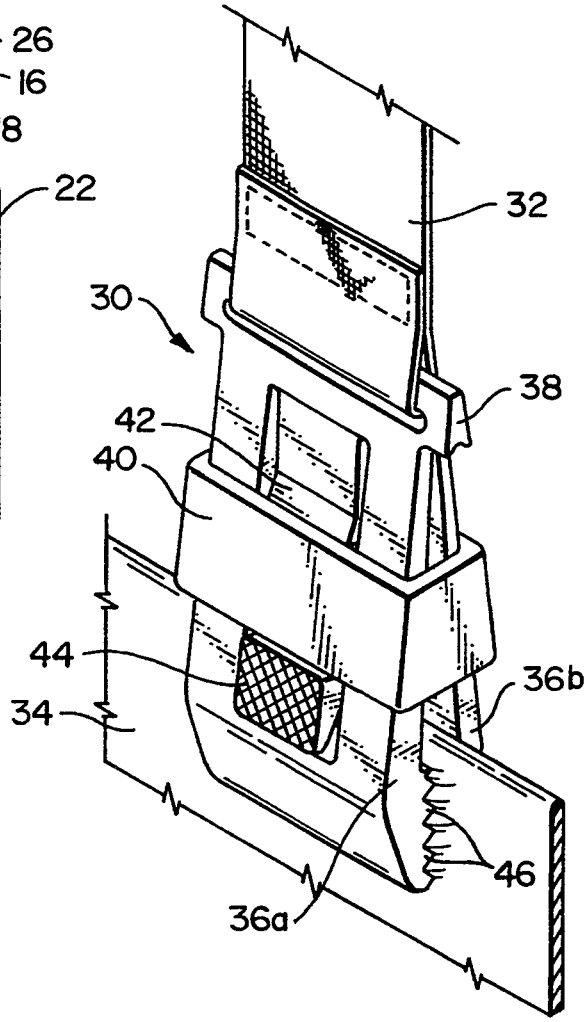
FIG. 2 is a perspective view of a clip in accordance with the present invention, this being shown employed as a suspender clip.

FIG. 2 shows a clip assembly 30 in accordance with the present invention. Inasmuch as this illustrative embodiment shows the assembly used as a suspender clip, this serves to interconnect the suspender strap 32 with the fabric 34 of the trouser waistband.

The clip assembly 30 is made up of four major subassemblies: (1) the opposable jaws **36*a*, 36*b*, (2) the attachment hoop 38, which forms attachment point for the suspender strap and also the live hinge at the base of the two jaws, (3) the locking collar 40 which slides over the tapered jaws to force them together against the fabric, and (4) the ratchet pawl 42 which engages internal teeth on collar 40** to hold the latter in place, until these teeth are moved out of engagement by depression of the release button on the end of the pawl.

Although the clip assembly may be formed of any suitable material, it is generally preferable to form it by injection molding of plastic or a similar process so that there are only two separate parts in the final assembly: a jaw assembly containing the jaw, attachment hoop, and ratchet pawl subassemblies, and a collar assembly containing the internally ratcheted locking collar subassembly. This arrangement is highly advantageous from the standpoint of simplicity, economy of manufacture, and durability.

The interrelation of the various elements and their operation will be described in greater detail below. Briefly, however, the device is operated by placing the clip assembly over the edge of the fabric of other sheet of material so that this is received between the first and second jaws **36*a*, 36*b*. Then, the locking collar is slipped downwardly over the tapered upper portions of the jaws, so as to force the teeth 46 on their lower ends against the fabric; as this is done, the internal teeth on the locking collar pass over the teeth on the ratchet pawl, which prevents reverse sliding motion of the collar (i.e., back toward the released position). Thus attached, the loads are transmitted from the fabric to the suspender strap or other load-bearing cord through the clip assembly. Then, to release the assembly, the unlocking button 44** is depressed, releasing the locking collar for movement back toward the apex of the tapered joint between the two jaws, allowing the latter to spread apart and disengage from the fabric.

b. Structure and Operation of Jaw Mechanism

Figure 3:
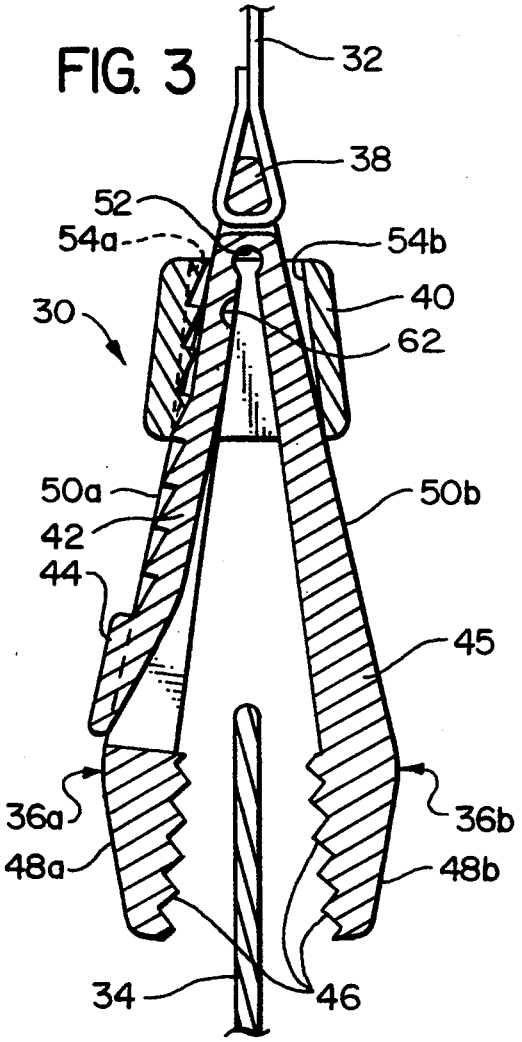
FIG. 3 is a side view of a cross section taken vertically through the clip assembly of FIG. 2, showing the jaws thereof in the initial, spread-apart configuration for receiving the sheet of fabric which is to be engaged.
Figure 4:
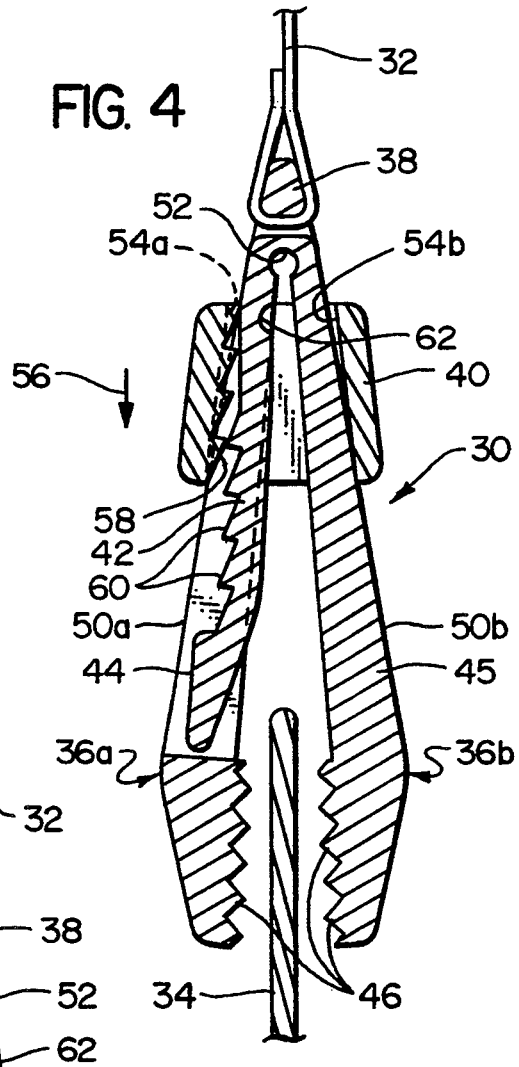
FIG. 4 is a view similar to FIG. 3 showing movement of the jaws towards the closed position in response to downward movement of the locking collar of the clip assembly.

FIGS. 3–4 illustrate the sequential operation of the clip assembly 30, as this is used to grasp the sheet material 34 and then release it again.

FIG. 3 shows the clip assembly in the open position, with the jaw portions **36*a*, 36*b* fully spread apart. As can be seen, each of the jaws comprises a lower grip portion 38 which bears the teeth 46, and an upper ramp portion 50, the ratchet pawl 42 being positioned in a rectangular "cutout" in the ramp portion of the first jaw 36*a*. The two upper ramp portions 50*a*, 50*b*, are joined at a live hinge 52 which extends the full width of the clip, and which forms the bottom half of the attachment loop 38. The ramp portions slope downwardly and outwardly from the hinge, a form a sliding engagement surface for the locking collar 40. The locking collar is provided with a corresponding tapered internal surfaces 54*a*,54*b*** which engage the two jaw ramp portions.

Figure 5:
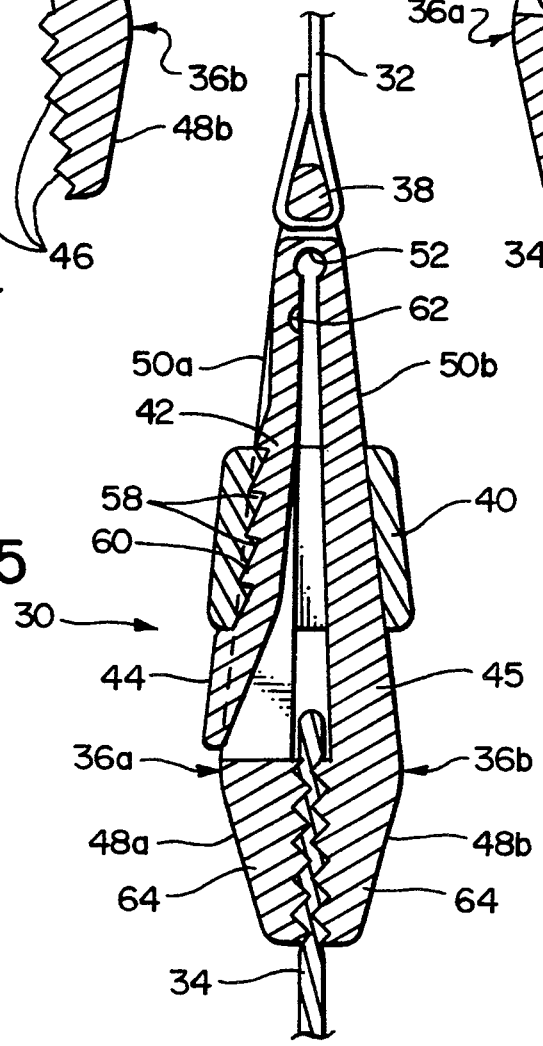
FIG. 5 is a view similar to FIGS. 3–4, showing the locking collar slid to the lowermost position, so that the jaws are forced into firm, gripping engagement with the sheet of fabric.

As can be seen in FIG. 5, the internal surfaces of the locking collar are tapered at an angle which corresponds to that of the ramp surfaces in the fully locked position, thus affording the greatest load-bearing engagement at this point, and ensuring that the material is firmly engaged by the jaws. However, as can be seen in FIG. 3, the internal taper of the locking collar (being fixed) is somewhat less than the angle between the two ramp portions when the jaws are spread in the open position; in this position, only the lower edges of the two internal surfaces engage the ramps, which is satisfactory because the jaws offer the least resistance to compression in this configuration, and the limited contact area results in minimal frictional resistance to sliding movement of the collar.

FIG. 4 shows the jaws beginning to move inwardly toward the engagement area as the locking collar is slid downwardly by the operator, in the direction indicated by the arrow 56. As this is done, internal teeth 58 on the locking collar ride over teeth 60 on the ratchet pawl 42. The two sets of teeth are configured to provide a ratcheting action, with sloped faces which permit downward sliding movement of the collar, and perpendicular faces which abut to prevent sliding movement in the reverse direction. The ratchet pawl 42 is provided with a live hinge 62 which enables the pawl to flex resiliently inwardly as the crests of the teeth move past one another, after which the pawl springs back outwardly to maintain engagement between the teeth.

FIG. 5 shows the assembly in the fully closed position. In this position, the locking collar has been pushed to the lowermost limit of its travel, with the upper edge of release button 44 acting as a limit stop. The tapered internal surfaces of the locking collar react against the surfaces of the ramp portions to drive the grip portions of the jaws firmly against the fabric or other sheet material. As noted above, the engagement surfaces of the collar and ramps lie flush against one another in this position to provide maximum resistance against spreading of the jaws. Similarly, the material 45 of the ramp portions is tapered from the hinge 52 downwardly so that the thickest area is adjacent the grip portion of the jaws, so as to provide the greatest resistance to bending at this point.

The multiplicity of teeth on the grip portions of the jaws (as opposed to the single row of teeth on the prior art sheet metal clips) ensure firm engagement over a relatively large area of the fabric. As can be seen in FIG. 5 the teeth 46 on the two jaws can advantageously be arranged so that the peaks on one fit into the valleys on the other; this causes the fabric (or other material) to be forced into a "zigzag" orientation by the high contact pressure between the jaws, providing enhanced resistance to pullout. The teeth themselves may be of any suitable configuration, such as parallel ridges (usually perpendicular to the direction of pull) or a multiplicity of individual points, for example; in any case, the relatively thickened material 64 of the grip portions 48 imparts rigidity and durability to the teeth, and permits a relatively deep pattern to be employed.

Figure 6:
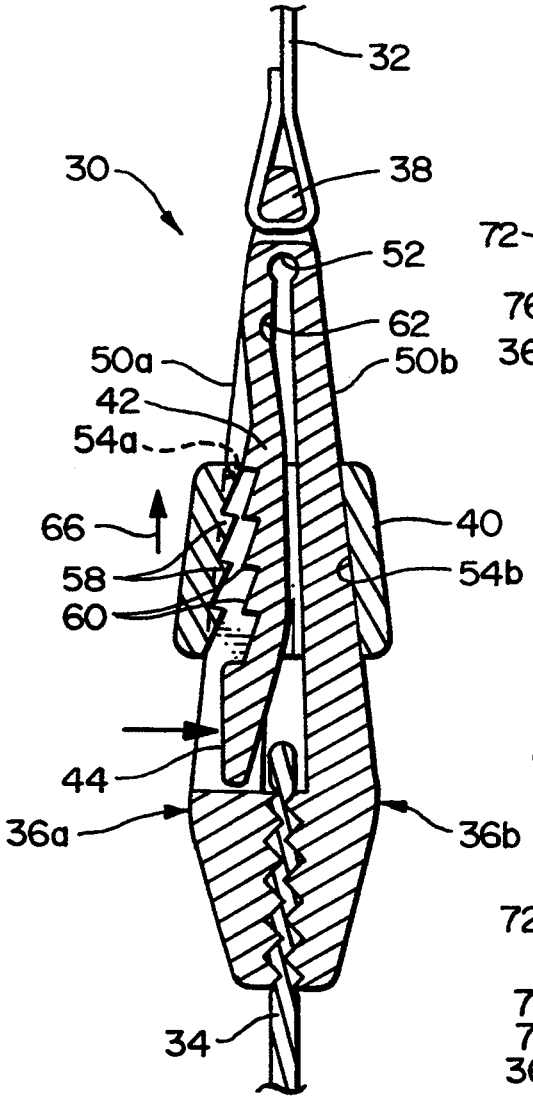
FIG. 6 is a view similar to FIGS. 3–5, showing the release button of the assembly having been depressed to release the ratchet pawl from engagement with the locking sleeve, permitting the latter to be said to the released position.

FIG. 6, in turn, illustrates the unlocking and release of the clip assembly. To achieve this, the operator simply depresses the release button 44 (the outer surface of which is preferably provided with knurling or features to enhance tactile qualities) so that the ratchet pawl flexes inwardly at its base hinge 62. This moves the two sets of ratchet teeth 58, 60 out of engagement, permitting the locking collar 40 to be slid back upwardly, in the direction indicated by arrow. As this is done, the two jaw portions 36*a*, 36*b*, being biased apart at their base hinge 52, spread to release the material 34, and return to the relaxed position shown in FIG. 3.

c. Attachment Loop

In many embodiments, the attachment loop for the suspender strap or other load bearing cord or line may be a simple, closed hoop. However, as was noted in the background section above, conventional suspender clips commonly wear out, leaving an otherwise serviceable set of suspenders useless, and it is therefore advantageous for certain embodiments of the present invention to include an opening loop which permits the clip assembly to be used as a replacement unit for an existing set of suspenders.

Figure 7:
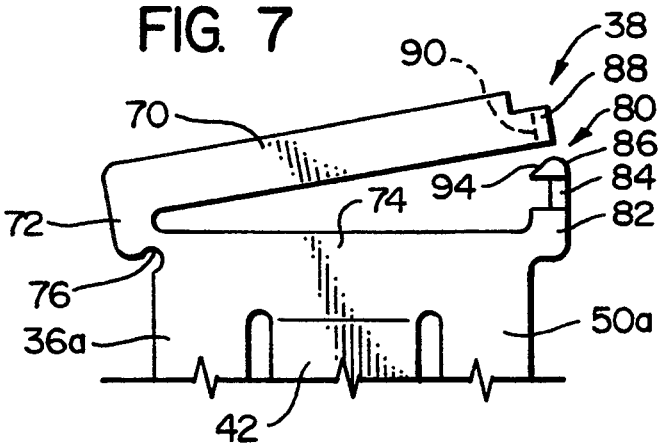
FIG. 7 is an elevational view of the upper end portion of the clip assembly of FIGS. 2–6 showing the attachment loop open to receive the end of a suspender strap therein.
Figure 8:
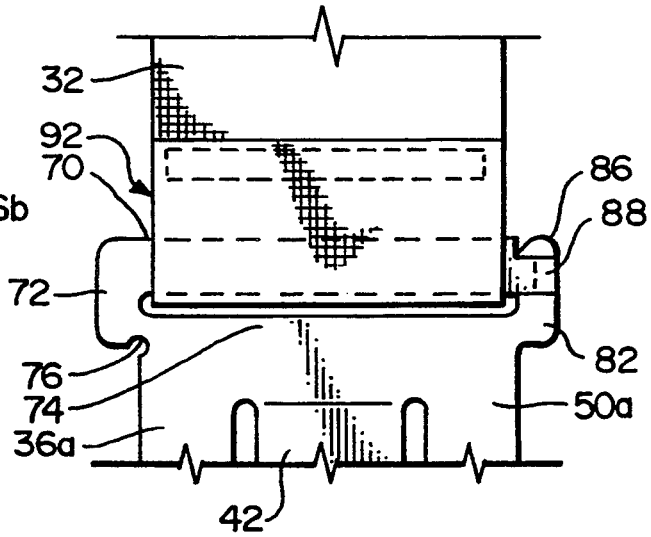
FIG. 8 is an elevational view similar to FIG. 7, showing the attachment loop closed and locked so as to retain the end of the suspender strap therein.

FIGS. 7–8 illustrate such an embodiment, in which the opening loop is molded as a unitary part of the clip assembly. As can be seen in the upper view, the upper part of the attachment hoop 38 is formed by a relatively straight, elongate arm 70 having a depending portion 72 at one end. The latter is joined to the lower portion 74 of the loop by a live hinge 76 which permits upward pivoting movement of arm 70. As was noted above, the lower portion 74 of the hoop assembly is formed in this embodiment by the spine of the jaw hinge 52.

A latching mechanism 80 is provided opposite hinge 76. On the lower side, there is an upwardly-projecting lug 82. This is notched partway up along its length, so as to form a relatively slender connecting portion 84 between the end cap 86 and base of the lug. A forked lug 88 extends longitudinally from the end of arm 70, and is sized to be received in notch in the fixed lug 82. A notch 90 in the end of forked lug 86, in turn, receives the slender connecting portion of the fixed lug, so as to establish firm engagement between the two members.

Thus, to install the clip assembly in the end of an existing suspender strap 32 as shown in FIG. 8, the arm 70 is first positioned in the open configuration and inserted through the fabric loop 92 at the end of the strap. The arm is then pressed downwardly (bending at hinge 76) so that the end of lug 86 strikes the inclined inner surface 94 of end cap 86. In response to this, the end of lug 82 flexes outwardly, permitting the forked lug 86 to pass by the end cap and enter the notch underneath. The fixed lug 82 then snaps back into position, so that end cap 86 extends over the end of lug 88, firmly retaining arm 70 in the closed position. It will be noted that the lower edge of the notch in lug 82 is a spaced distance above bottom portion of the loop assembly, and that arm 70 extends parallel thereto in the closed position, so that an elongate slot is provided to accommodate the fabric of the suspender strap loop.

d. Additional Embodiments

Figure 9:
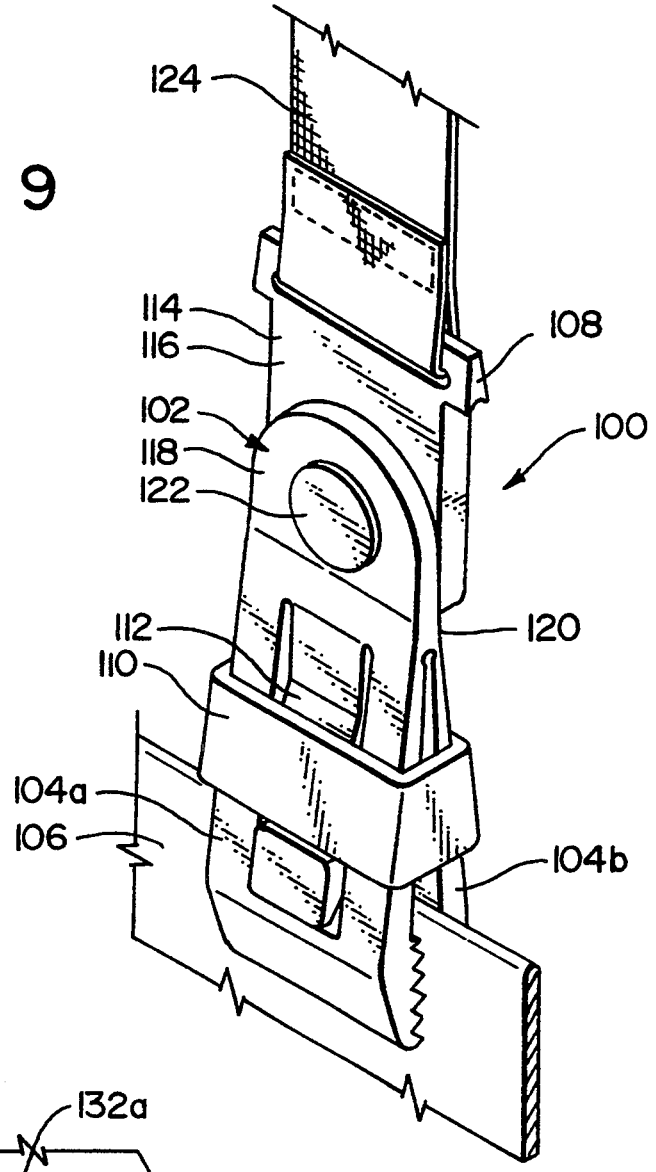
FIG. 9 is a perspective view of a clip assembly in accordance with a second embodiment of the present invention, wherein the attachment for the suspender strap is provided on a subassembly which is pivotally mounted to the jaws which engage the fabric material, so as to minimize pivoting wear on the latter.

FIG. 9 shows a clip assembly 100 which is provided with a pivoting joint 102 which helps reduce wear and damage to the fabric which is gripped by the clip. The assembly comprises jaws 104*a*, 104*b* which grip the fabric 106, attachment loop 108, locking collar 110, and ratchet pawl 112, all of which are substantially identical to the corresponding elements in the embodiment described above, and so will not be described again in detail.

In the embodiment which is illustrated in FIG. 9, however, the jaws and the suspender attachment loop are interconnected by the mid-body pivot joint 102. The upper edge of a first plate member 114 forms the bottom of the attachment hoop 108, and extends downwardly therefrom to form a first flat bearing surface 116. A second plate member 118 extends upwardly from the spine of the hinge between jaws 104*a*, 104*b*, so as to form a second bearing surface 120. The two bearing surfaces lie flush against one another along a common plane which extends generally parallel to the fabric which is gripped in the jaws, and are joined by a relatively large-diameter pivot pin 122 which extends perpendicular to this plane. The pivot pin extends from the first plate member through a cooperating bore formed in the second, and the head of the pin is flared to prevent the two parts from separating.

Thus joined, the two plate members are free to pivot relative to one another along the common plane. Being that the jaw portions are attached to one of these members and the attachment hoop to the other, relative movement between the fabric 106 and the suspender strap 124 is not translated into twisting movement of the jaws in the plane of the fabric. This (plus the relatively large contact area of the jaws) greatly reduces wear of the fabric 106 at the attachment areas. User comfort is also somewhat enhanced by the freedom of movement between the straps and the trousers waistband.

Figure 10:
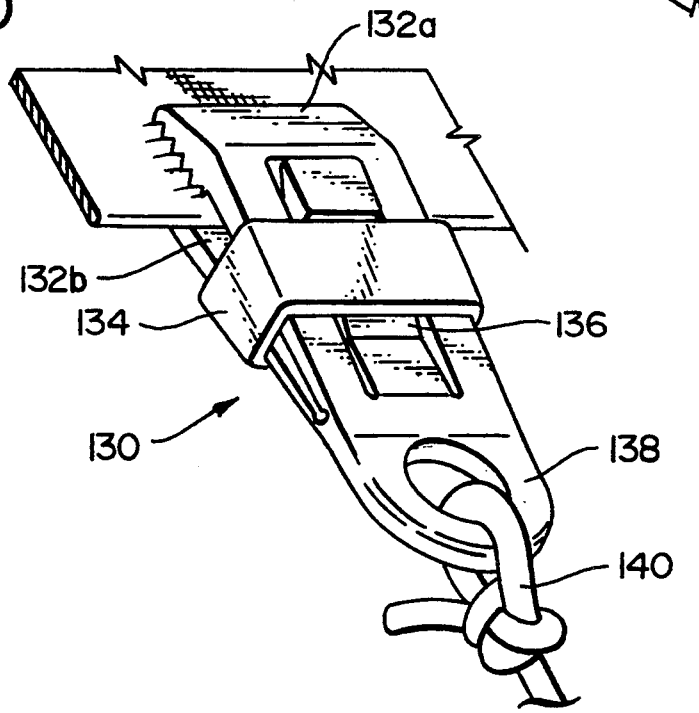
FIG. 10 is a perspective view of a clip assembly in accordance with another embodiment of the present invention, wherein the attachment plate of the assembly is configured for attachment to a rope or other line, as may be desired as a tie-down for tarpaulins, Visquene, or similar sheet material.

FIG. 10, in turn, illustrates an embodiment of the present invention which is somewhat more "generic" in nature, in that this may be used with any variety of ropes, cords, etc., as opposed to the suspender straps discussed above.

As can be seen, most of the clip assembly 130 is substantially identical to the embodiment which was described with respect to FIG. 2, in that this again comprises hinged jaws 132*a*, 132*b*, locking collar 134, and ratchet pawl 136. The principal difference lies in the use of a closed ring or eye 138 for the attachment loop. This permits a rope 140 or other cord to be threaded through the opening in the eye and tied off, as is shown in FIG. 10. The diameter of the opening in the eye is preferably selected to permit use of ropes within a predetermined range of sizes. This embodiment is particularly suited for securing tarps and sheets of Visquene or similar material, particularly if the original grommets have been torn out of the former.

In this context, it should be noted that the clip assemblies of the present invention may be employed for gripping a great variety of materials, or for attachment to a wide variety of load-bearing lines or members (e.g., clothes lines), in addition to those which have been described above, and may be particularly configured to suit these applications. For example, the clip assembly of the present invention may be used for lifting or handling sheets of rigid or semirigid material, such as plywood or sheet metal, and may have jaws which are particularly configured to grip these materials. Also, the steepness and length of the ramp portions of the jaws may be varied depending on the amount of contact pressure and ease of operation desired. Still further, the clip assembly may be fabricated of various materials, such as various plastics and metals, depending on the intended application.

These and many other modifications may be made to the illustrative embodiments described above without departing from the spirit and scope of the present invention. Accordingly, the invention is not to be limited except as by the appended claims.

What is claimed is:

1. A clip assembly for gripping a sheet of material, said clip assembly comprising:

first and second jaw members mounted to a hinge portion in opposition to one another, each said jaw member comprising:

a grip portion for engaging said sheet of material; and a ramp portion which extends from said hinge portion toward said grip portion;

said ramp portions of said first and second jaw members forming inclined planes which diverge from one another from said hinge portion toward said grip portions;

a collar member surrounding said ramp portions of said first and second jaw members, so that in response to sliding movement of said collar member from said hinge portion toward said grip portions said collar member rides up said divergent inclined planes so as to force said grip portions together against said sheet of material; and ratchet means for preventing reverse movement of said collar member from said grip portions of said jaw members toward said hinge portion, and for selectively releasing said collar member for said reverse movement so as to permit disengagement of said jaw members from said sheet of material, said ratchet means comprising:

a first set of ratchet teeth formed on said collar member;

a second set of ratchet teeth mounted to at least one said jaw member; and a ratchet pawl having said second set of ratchet teeth formed thereon, said ratchet pawl being mounted to said at least one jaw member for resilient deflection so as to permit said first set of teeth to ride over said second set of teeth as said collar member is moved toward said grip portions of said jaw members.

2. The clip assembly of claim 1, further comprising:

a loop portion for attachment to a load-bearing cord.

3. The clip assembly of claim 2, wherein said loop portion is selectively openable to receive a loop formed on an end of said cord.

4. The clip assembly of claim 3, wherein said loop portion comprises:

a fixed lug member mounted to said jaw members proximate a first end of said hinge portion;

an arm member having a first end which is hinged mounted to said jaw members proximate a second end of said hinge portion and a second end which defines an opening with said fixed lug member for receiving said loop on said end of said cord; and latch means for selectively attaching said second end of said arm member to said fixed lug member so said loop on said end of said cord is retained in a closed loop formed intermediate said arm member and said hinge portion of said clip assembly.

5. The clip assembly of claim 3, wherein said openable loop portion is configured to receive a loop formed on an end of a suspender strap.

6. The clip assembly of claim 2, wherein said loop portion is a fixed ring portion to which said end of said cord may be tied.

7. The clip assembly of claim 2, further comprising:

hinge means for pivotally mounting said loop portion of said assembly to said jaw members of said assembly.

8. The clip assembly of claim 7, wherein said hinge means comprises:

a first plate member mounted to said loop portion and having a flat bearing surface formed thereon;

a second plate member mounted to said jaw members and having a flat bearing surface formed thereon; and a pivot pin for mounting said first and second plate members together so that said flat bearing surfaces abut one another for pivoting movement along a common plane.

9. The clip assembly of claim 8, wherein said common plane along which said bearing surfaces abut lies substantially parallel to a plane in which said jaw members are configured to hold said sheet of material, so that said hinge means eliminates twisting movement of said jaw members against contact surfaces of said sheet of material owing to relative movement between said material and said load-bearing cord.

10. The clip assembly of claim 1, further comprising:

means for selectively deflecting said ratchet pawl so that said second set of teeth move out of engagement with said first set of teeth, so as to permit said reverse movement of said collar member and disengagement of said jaw members from said sheet of material.

11. The clip assembly of claim 10, wherein said ratchet pawl comprises:

an elongate, toothed member having a first end which is hingedly mounted to said least one jaw portion and a second end which is free so as to permit displacement of said pawl so that said sets of teeth move out of engagement with one another.

12. The clip assembly of claim 11, wherein said means for selectively deflecting said ratchet pawl comprises:

a button portion mounted on said free end of said elongate, toothed member so as to permit selective manual deflection of said ratchet pawl.

13. The clip assembly of claim 12, wherein said elongate, toothed member of said ratchet pawl extends substantially coextensive with said ramp portion of said at least one jaw member, said toothed member having said first set of teeth on an outer surface thereof and said collar member having said second set of teeth on an inner surface thereof for engaging said first set on said pawl.

14. The clip assembly of claim 13, wherein said button portion on said free end of said elongate, toothed member faces outwardly so in response to application of finger pressure on said button portion said ratchet pawl is deflected inwardly so that said first and second sets of teeth move out of engagement with one another.

15. The clip assembly of claim 1, wherein said grip portions of said first and second jaw members each comprise:

a generally planar grip face which defines a contact area for engaging said sheet of material; and a plurality of teeth formed on said grip face for engaging said material.

16. The clip assembly of claim 15, wherein tips of said plurality of teeth on said grip face of said first jaw member are configured to be received in valleys between said plurality of teeth on said grip face of said second jaw member.

17. The clip assembly of claim 16, wherein said teeth on said grip faces comprise a plurality of parallel ridges formed on said grip faces.

18. A clip assembly for gripping a sheet of material, said clip assembly comprising:

first and second jaw members mounted to a hinge portion in opposition to one another, each said jaw member comprising:

a grip portion for engaging said sheet of material; and a ramp portion which extends from said hinge portion toward said grip portion;

said ramp portions of said first and second jaw members forming inclined planes which diverge from one another from said hinge portion toward said grip portions;

a collar member surrounding said ramp portions of said first and second jaw members, so that in response to sliding movement of said collar member from said hinge portion toward said grip portions said collar member rides up said divergent inclined planes so as to force said grip portions together against said sheet of material;

rachet means for preventing reverse movement of said collar member from said grip portions of said jaw members toward said hinge portion, and for selectively releasing said collar member for said reverse movement so as to permit disengagement of said jaw members from said sheet of material;

a loop portion for attachment to a load-bearing cord; and hinge means for pivotally mounting said loop portion of said assembly to said jaw members of said assembly; said hinge means comprising:

a first plate member mounted to said loop portion and having a flat bearing surface formed thereon;

a second plate member mounted to said jaw members and having a flat bearing surface formed thereon; and a pivot pin for mounting said first and second plate members together so that said flat bearing surfaces abut one another for pivoting movement along a common plane which lies substantially parallel to a plane in which said jaw members are configured to hold said sheet of material;

so that said hinge means eliminates twisting movement of said jaw members against contact surfaces of said sheet of material owing to relative movement between said material and said load-bearing cord.

* * * * *